US008409419B2

(12) United States Patent
Kruesi

(10) Patent No.: US 8,409,419 B2
(45) Date of Patent: Apr. 2, 2013

(54) CONVERSION OF CARBON TO HYDROCARBONS

(76) Inventor: Paul R. Kruesi, Golden, CO (US)

( * ) Notice: Subject to any disclaimer, the term of this patent is extended or adjusted under 35 U.S.C. 154(b) by 360 days.

(21) Appl. No.: 12/467,618

(22) Filed: May 18, 2009

(65) Prior Publication Data

US 2010/0276298 A1 Nov. 4, 2010

Related U.S. Application Data

(60) Provisional application No. 61/055,140, filed on May 21, 2008.

(51) Int. Cl.
*C25B 3/00* (2006.01)
*C25B 3/02* (2006.01)

(52) U.S. Cl. ..... 205/462; 205/450; 205/452

(58) Field of Classification Search ..... 205/450, 205/452, 462
See application file for complete search history.

(56) References Cited

U.S. PATENT DOCUMENTS

| | | | | |
|---|---|---|---|---|
| 2,198,673 | A | 4/1940 | Loevenstein | |
| 2,964,551 | A | 12/1960 | Woolcock | |
| 3,755,099 | A | 8/1973 | Haupin | |
| 3,765,851 | A | 10/1973 | White | |
| 3,843,457 | A | 10/1974 | Grannen et al. | |
| 3,870,611 | A | 3/1975 | Vestal | |
| 3,958,957 | A | 5/1976 | Koh et al. | |
| 3,959,096 | A | 5/1976 | Langer | |
| 4,010,098 | A | 3/1977 | Fassell | |
| 4,021,298 | A | 5/1977 | Jones | |
| 4,039,433 | A | 8/1977 | Peterson | |
| 4,092,129 | A | 5/1978 | Goudal | |
| 4,118,292 | A | 10/1978 | Fray et al. | |
| 4,148,710 | A | 4/1979 | Burton, III | |
| 4,148,752 | A | 4/1979 | Burger et al. | |
| 4,158,637 | A | 6/1979 | Jones | |
| 4,166,786 | A | 9/1979 | Duraiswamy et al. | |
| 4,219,415 | A | 8/1980 | Nassef et al. | |
| 4,246,255 | A | 1/1981 | Grantham | |
| 4,259,414 | A | 3/1981 | Williams | |
| 4,268,363 | A * | 5/1981 | Coughlin | 205/367 |
| 4,279,710 | A | 7/1981 | Coughlin | |
| 4,389,288 | A * | 6/1983 | Vaughan | 205/555 |
| 4,435,374 | A | 3/1984 | Helm, Jr. | |
| 4,447,262 | A | 5/1984 | Gay et al. | |
| 4,515,659 | A | 5/1985 | Wingfield, Jr. et al. | |
| 4,670,113 | A | 6/1987 | Lewis | |
| 4,721,656 | A | 1/1988 | Vance et al. | |
| 4,752,364 | A * | 6/1988 | Dhooge | 205/688 |
| 4,793,904 | A | 12/1988 | Mazanec et al. | |
| 4,874,485 | A * | 10/1989 | Steele | 205/688 |
| 4,897,167 | A | 1/1990 | Cook | |
| 4,904,356 | A | 2/1990 | Fray | |
| 4,906,290 | A | 3/1990 | Worner | |
| 4,962,264 | A | 10/1990 | Forester | |
| 4,988,417 | A | 1/1991 | DeYoung | |
| 5,064,733 | A | 11/1991 | Krist et al. | |
| 5,084,140 | A | 1/1992 | Holland | |
| 5,090,999 | A | 2/1992 | Iwase | |
| 5,314,171 | A | 5/1994 | Friedrichs et al. | |
| 5,330,623 | A | 7/1994 | Holland | |
| 5,364,821 | A | 11/1994 | Holland | |
| 5,387,321 | A | 2/1995 | Holland | |
| 5,441,990 | A | 8/1995 | Robin et al. | |
| 5,470,380 | A | 11/1995 | Jiang et al. | |
| 5,678,762 | A | 10/1997 | Wood et al. | |
| 5,788,739 | A | 8/1998 | Margulis | |
| 5,821,395 | A | 10/1998 | Price et al. | |
| 5,853,687 | A | 12/1998 | Morlec et al. | |
| 5,948,398 | A | 9/1999 | Hanamoto et al. | |
| 6,184,427 | B1 | 2/2001 | Klepfer et al. | |
| 6,294,068 | B1 | 9/2001 | Petrovic et al. | |
| 6,299,994 | B1 | 10/2001 | Towler et al. | |
| 6,409,974 | B1 | 6/2002 | Towler et al. | |
| 6,451,094 | B1 | 9/2002 | Chang et al. | |
| 6,458,478 | B1 | 10/2002 | Wang et al. | |
| 6,548,197 | B1 | 4/2003 | Chandran et al. | |
| 6,929,752 | B2 | 8/2005 | Cansell | |
| 7,008,463 | B2 | 3/2006 | Furuya | |
| 7,425,315 | B2 | 9/2008 | Kruesi | |
| 2003/0106806 | A1 | 6/2003 | Bandlish et al. | |
| 2004/0216698 | A1 | 11/2004 | Zilka et al. | |
| 2005/0137078 | A1 | 6/2005 | Anderson et al. | |
| 2005/0139484 | A1 | 6/2005 | Brooks et al. | |
| 2009/0084225 | A1 | 4/2009 | Kruesi | |

FOREIGN PATENT DOCUMENTS

| | | |
|---|---|---|
| AU | 624369 | 6/1992 |
| DE | 867005 | 2/1953 |
| EP | 0272803 | 6/1988 |
| EP | 0780457 | 6/1997 |
| FR | 2322115 | 3/1977 |
| GB | 2256435 | 4/1995 |
| JP | 59-059846 | 4/1984 |
| WO | WO 91/05735 | 5/1991 |

OTHER PUBLICATIONS

Fukunaka et al., "Mass-Transfer Rate on a Plane Vertical Cathode With Hydrogen Gas Evolution", J. Electrochem. Soc. (Apr. 1989), vol. 136, No. 4, pp. 1002-1009.*

Extended European Search Report for European Patent Application No. 09160828-1, dated Oct. 15, 2009.

Appell, et al., "Converting Organic Wastes to Oil, A Replenishable Energy Source", Report of Investigations 7560, 1971, pp. 1-20, United States Department of the Interior, Bureau of Mines.

Author Unknown, "A way to turn driftwood into charcoal, vinegar and gas", Chemical Engineering, Apr. 2003, p. 19.

Berkley, "Considerations regarding the definition of remotely located integrated congeneration plants. Part 1", CIM Bulletin, Feb. 2003, pp. 59-63, vol. 96, No. 1068.

(Continued)

*Primary Examiner* — Edna Wong

(74) *Attorney, Agent, or Firm* — Sheridan Ross P.C.

(57) ABSTRACT

The invention provides methods of forming lower alkyls and alcohols from carbon sources thermally and/or electrolytically.

15 Claims, No Drawings

OTHER PUBLICATIONS

Boley, et al., "Entrainment Drying and Carbonization of Wood Waster", Report of Investigation 7282, Aug. 1969, pp. 1-15, United States Department of the Interior, Bureau of Mines.
Brisard, "An Electroanalytical Approach for Investigating the Reaction Pathway of Molecules at Surfaces", The Electrochemical Society-Interface, Summer 2007, pp. 23-25, vol. 16, No. 2.
Chase, "Microwave Pyroysis for Waster Minimisation: Recovery of Aluminium & Hydrocarbons from Packaging Laminates", Department of Chemical Engineering, University of Cambridge, at least as early as 2001, pp. 1-4.
Chemat, et al., "Microwave assisted pyrolysis of urea supported on graphite under solvent-free conditions", Tetrahedron Letters, 2001, pp. 3693-3695, vol. 42.
Cox, et al., "Separation of Mg and Mn from Beverage Can Scrap using a Recessed-Channel Cell", Journal of The Electrochemical Society, 2003, pp. D200-D208, vol. 150(12), The Electrochemical Society, Inc.
Cleland, et al., "Refining of aluminium bismuth and zinc alloys", Institution of Mining and Metallurgy, Sep. 1979, pp. 1-6.
El Harfi, et al., "Pyrolysis of the Moroccan (Tarfaya) oil shales under microwave irradiation", Fuel, 2000, pp. 733-742, vol. 79.
Huang, et al., "Activation of methane in microwave plasmas at high pressure", Research on Chemical Intermediates, 2001, vol. 27, No. 6, pp. 643-658.
Kato, "Organic Wastes as BioMass Energy Resources and Carbon Dioxide Fixation From Brewery Processing Water", Brewery Association, 2001, pp. 758-762, vol. 96, No. 11, (Translated by the McElroy Translation Company, pp. 1-10).
Kobler, et al., "Plastics from Shredder Residue: Pilot Plant Experiences and Data", SME Annual Meeting, Denver, Colorado, 2001, pp. 1-6.
Lee, et al., "Verifying Predictions of Water and Current Distributions in a Serpentine Flow Field Polymer Electrolyte Membrane Fuel Cell", Journal of The Electrochemical Society, 2003, pp. A341-A348, vol. 150, No. 3.
Lu, et al., "SOFCs for Direct Oxidation of Hydrocarbon Fuels with Samaria-Doped Ceria Electrolyte", Journal of The Electrochemical Society, 2003, pp. A354-A358, vol. 150, No. 3.
Menéndez, et al., "Microwave-induced pyrolysis of sewage sludge", Water Research, 2002, pp. 3261-3264, vol. 36.
Monsef-Mirzai, et al., "Rapid Microwave pyrolysis of coal", Fuel, 1995, pp. 20-27, vol. 74, No. 1.
Nicks, et al., "Catalytic Activity of Rare-Earth Oxides for the Oxidation of Hydrogen", Reno Metallurgy Research Center; Report of Investigation 7841, date unknown, pp. 1-9, United States Department of the Interior, Bureau of Mines, Reno, NV.
Ogura, et al., "Reduction of $CO^2$ to Ethylene at Three-Phase Interface Effects of Electrode Substrate and Catalytic Coating", Jourrial of The Electrochemical Society, 2005, vol. 152, No. 12, pp. D213-D219.
Parry, et al., "Drying and Carbonizing Fine Coal in Entrained and Fluidized State", Report of Investigations 4954, Apr. 1953, pp. 1-43, United States Department of the Interior, Bureau of Mines.
Perry, et al., "Energy Utilization, Conversion, and Resource Conservation", Perry Chemical Engineering Handbook, Sixth Edition, Section 9-4, 1984.
Perry, et al., "Solid Fuels", Perry Chemical Engineering Handbook, Sixth Edition, Section 9-7, 1984.
Sasaki, et al., "Equilibria in Fuel Cell Gases: I Equilibrium Compositions and Reforming Conditions", Journal of The Electrochemical Society, 2003, pp. A878-A884, vol. 150, No. 7.
Venkataraman, et al., "Development of new CO Tolerant Ternary Anode Catalysts for Proton Exchange Membrane Fuel Cells", Journal of the Electrochemical Society, 2003, pp. A278-A284, vol. 150, No. 3.
Wolfson, et al., "Destructive Distillation of Scrap Tires", Report of Investigations 7302, Sep. 1969, pp. 1-19, United States Department of the Interior, Bureau of Mines.
Partial European Search Report for European Application No. 09160828.1, dated Jul. 22, 2009.

* cited by examiner

CONVERSION OF CARBON TO HYDROCARBONS

RELATED APPLICATIONS

The present application claims the benefit of U.S. Provisional Application Ser. No. 61/055,140, filed May 21, 2008, entitled "CONVERSION OF CARBON TO HYDROCARBONS", which is incorporated herein by this reference in its entirety.

FIELD OF THE INVENTION

The invention relates to the electrolytic production of useful hydrocarbons from micron scale carbon sources.

BACKGROUND OF THE INVENTION

The recent emphasis on recycling and recovery of valuable components in industrial as well as residential and environmental waste streams has spawned a growing pool of raw carbon resources. For example, U.S. Pat. No. 7,425,315 entitled "Method To Recapture Energy From Organic Waste," and incorporated herein by reference, teaches methods of recovering carbon from organics-containing waste streams, and the special properties that the recovered carbon possesses. As described in that disclosure, organic waste covers a very broad range of materials, such as auto shredder residue (produced at a level of at least 4 million tons per year and containing potentially 1.4 million tons of carbon) and municipal waste (256 million tons per year potentially producing 90 million tons of carbon). These resources are of interest due to the high level of metallic values in the waste, including, in the case of municipal waste, about one half the used aluminum beverage cans sold in the U.S. per year.

Another source of carbon, lacking any metallic values, is the large amount of waste wood generated in the clean up of forest and Bureau of Land Management property. There have been numerous proposals to use the waste wood for the generation of energy. At an estimated 80 tons of waste wood per acre of land, millions of tons of carbon would be recovered in these energy extraction methods. Similarly, carbon will be recovered from the large supplies of chicken litter and bovine and hog excrement that are starting to be diverted into energy production technologies. Each of these carbon sources represent an undesirable environmental problem that could become a major energy source.

Another potential carbon source includes the wastes from coal processing. "Gob Piles" and "Black Ponds" containing 38 million tons per year represent 5 million tons of carbon. Oil sand residue, oil shale and heavy crude oil, which are not now recoverable, augment a very large total.

The carbon produced in many of these recovery processes, and particularly in the process described in U.S. Pat. No. 7,425,315, entitled "Method To Recapture Energy From Organic Waste" no longer resembles the organic waste from which it originated. For example, the organic waste from auto shredder residue, which includes plastics, rubber, urethane, and cellulosics such as cloth and wood, becomes carbon. The carbon is in chains and cross-linked, but very fine. It has been shown to range from about 2 to about 20 microns in diameter, which is not nano-scaled, but micron-scaled. The result is a very high surface area carbon product that is also very porous to gases and liquids. It is, therefore, ideal for processing into valuable products. While the carbon produced will have an inherent energy value, dependent upon the source and purity of the product, its value, as a combustion product is probably comparable to coal at approximately \$40-\$60 per ton. It is recognized that the economic conversion of this carbon to hydrocarbons such as methane, methanol, ethanol, and propane would greatly enhance the value of its production. This added value would greatly enhance the environmental benefits foreseen in utilizing the waste recycling and carbon recovery processes described above.

DESCRIPTION OF THE INVENTION

The present invention is drawn to a process that can efficiently transform raw carbon sources into desirable hydrocarbon products. The current interest in energy production, and the carbon-carbon dioxide cycle in nature, has resulted in a great deal of useful research that is related to the thermodynamics of the processes of the present invention. A study of the electrochemical reduction of carbon dioxide producing a number of hydrocarbons, but emphasizing ethylene, is described in K. Ogure, et al, "Reduction of Carbon Dioxide to Ethylene at a Three Phase Interface Effects of Electrode Substrate and Catalytic Coating" *Journal of the Electrochemical Society* 152(12):D213-D219 (2005). The effects of certain catalysts on specificity in this research are noteworthy. Also of interest is a study of the thermodynamic relationships of hydrocarbons, such as methane, methanol, ethanol and propane, when used in fuel cells, as a function of temperature as described in "Equilibria in Fuel Cell Gases" *Journal of the Electrochemical Society* 150(7):A878-A884 (2003). Another publication of interest is Brisard, "An Electroanalytical Approach for Investigating the Reaction Pathway of Molecules at Surfaces" *The Electrochemical Society-Interface* 16(2):23-25 (2007). This research shows pathways on certain catalytic surfaces for the conversion of $CO_2$ and CO down to certain hydrocarbons. The processes of the present invention show that reactions proceeding in the opposite direction, from carbon up to hydrocarbons, are both catalytically and thermodynamically feasible and the hydrocarbons reliably and reproducibly produced are useful as fuel sources.

Given the particular properties of the carbon produced in the recovery of precious components from carbon-containing waste streams, and particularly the carbon produced via the processes described in U.S. Pat. No. 7,425,315, as described above to be a cross-linked, but very fine carbon of about 2 to about 20 microns in diameter, and having a very high surface area that is also very porous to gases and liquids, and is useful in the production of hydrogen ions and electrons. A first reaction occurring at the anode:

$$C+2H_2O \leftrightarrow CO_2+4H^++4e^- \quad \text{(Reaction 1)}$$

Reaction 1 has a small positive Gibbs free energy and is therefore driven by reactions occurring at the cathode. It has been shown that certain electrolyte salts, such as magnesium chloride, strontium chloride, and zinc chloride, retain water at temperatures as high as 200° C. This water is tightly bound to chloride salt under certain temperature conditions and has limited activity. Under other temperature conditions, the water is free and of normal activity. This can play an important role in hydrocarbon preparation.

A second building block is carbon monoxide, prepared from the carbon, which can play an important role at a cell cathode. The carbon monoxide can be prepared thermally:

$$2C+O_2 \leftrightarrow 2CO \quad \text{(Reaction 2)}$$

or electrochemically:

$$C+H_2O \leftrightarrow CO+2H^++2e^- \quad \text{(Reaction 3)}$$

The hydrogen and electrons are reacted at an anode, preferably a silver-plated anode, with oxygen (air) to give water. This provides the needed voltage. The advantage of the electrochemical preparation is the purity of the product, which can be a real benefit in later operations.

Methane Production

Methane may be prepared using two carbons in the anodic Reaction 1 above, to provide 8 electrons and 8 hydrogens ($2C+4H_2O \leftrightarrow 2CO_2+8H^++8e^-$). At one cathode, 4 hydrogens and electrons react with cathodic carbon to produce methane:

$$4H^++4e^-+C \leftrightarrow CH_4 \quad \text{(Reaction 4)}$$

The 4 additional hydrogen ions are reacted with oxygen (air) at the two part cathode to produce water:

$$4H^++4e^-+O_2 \leftrightarrow 2H_2O \quad \text{(Reaction 5)}$$

These three reactions (Reaction 1, 4 and 5) combine for an overall reaction in the cell:

$$3C+2H_2O+O_2 \leftrightarrow 2CO_2+CH_4 \quad \text{(Reaction 6)}$$

Methane production in this cell will require 2.2 pounds of carbon per pound of methane.

Alternatively, a copper cathode may be used to produce methane and water from carbon monoxide and hydrogen ions:

$$CO+6H^+ \leftrightarrow CH_4+H_2O \quad \text{(Reaction 7)}$$

If the salt electrolyte at this cathode is at the proper temperature to have water fully complexed, this water will join the salt and help drive the reaction. In instances when such copper cathodes are used, the other electrons and hydrogen ions are reacted with oxygen at a split of the cathode, producing water:

$$2H^++2e+\tfrac{1}{2}O_2 \leftrightarrow H_2O \quad \text{(Reaction 8)}$$

These three reactions (Reaction 3, 7 and 8) combine for an overall reaction in the cell:

$$2C+2H_2O+CO+\tfrac{1}{2}O_2 \leftrightarrow 2CO_2+CH_4 \quad \text{(Reaction 9)}$$

Methane production in this cell will require 3 pounds of carbon per pound of methane.

In both cases, these cathodic reactions (Reaction 5 and Reaction 8, above) provide the voltage to drive the other two reactions (anodic, Reaction 1 and cathodic methane production, Reaction 4 and Reaction 6).

Methanol Production

Methanol is another product that can be produced from the special carbon recovered from the waste carbon sources as described above, particularly the carbon recovered via the processes described in U.S. Pat. No. 7,425,318. Again utilizing Reaction 1 of water and carbon at the anode, just as described above for methane production, four hydrogen ions and four electrons are created. At a carbon cathode, water and two of the hydrogen ions and electrons are added producing methanol:

$$C+H_2O+2H^++2e^- \leftrightarrow CH_3OH \quad \text{(Reaction 10)}$$

This reaction at the carbon cathode (Reaction 10) is enhanced by the presence of copper or cuprous chloride. At a part of the split cathode, hydrogen ions are reacted with oxygen (air) to produce water as in Reaction 8 above, and the resulting voltage drives the first two Reactions 1 and 10. The overall reaction in these cells is therefore:

$$2C+\tfrac{1}{2}O_2+2H_2O \leftrightarrow CO_2+CH_3OH \quad \text{(Reaction 11)}$$

In this case, 0.75 pounds of carbon is required to produce a pound of methanol.

In this cell and in the production of methane described above, the cathode can be changed to a copper plate and carbon monoxide can be used at the first cathode:

$$O_2+2C+2H_2O+CO \leftrightarrow 2CO_2+CH_3OH \quad \text{(Reaction 12)}$$

This requires two carbons and four waters at the anode, to produce eight hydrogen ions and electrons for these reactions. In this second case using a copper cathode, 1.12 pounds of carbon will per pound of methanol.

Ethanol Production

Ethanol is another hydrocarbon currently in demand, that may be produced electrochemically from the carbon sources described above. The reaction requires two carbons at the anode reacting with water to produce eight hydrogen ions and electrons, as in Reaction 1 above. At a first cathode, two carbons and water and four hydrogen ions and electrons produce ethanol:

$$2C+H_2O+4H^++4e^- \leftrightarrow {}^{CH}{}_3CH_2OH \quad \text{(Reaction 13)}$$

This reaction is preferably catalyzed by the presence of copper, cuprous chloride and other metals.

At the split cathode, the remaining 4 hydrogen ions and electrons react with oxygen (air) to produce 2 water molecules, as in Reaction 8 above. Therefore the overall reaction in this cell is:

$$4C+3H_2O+O_2 \leftrightarrow 2CO_2+CH_3CH_2OH \quad \text{(Reaction 14)}$$

In this reaction 1.042 pounds of carbon produce a pound of ethanol.

Propane Production

Another hydrocarbon of interest that may be produced electrochemically from carbon is propane. It is a widely useful fuel of high value that is recovered from natural gas. It has a low free energy at room temperature and is unstable at temperatures above 200° C.

Beginning with the carbon sources described above, and particularly via the processes described in U.S. Pat. No. 7,425,315, two carbons are reacted with four waters at the anode to produce eight hydrogen ions and electrons, as in Reaction 1. At one cathode, four hydrogen ions and electrons are reacted with two moles of methanol and carbon to produce propane and two water molecules:

$$C+2CH_3OH+4H^++4e^- \leftrightarrow CH_3CH_2CH_3+2H_2O \quad \text{(Reaction 15)}$$

This first cathodic Reaction 15 is aided by a salt electrolyte, which absorbs and binds water.

The other four hydrogens react with oxygen (air) at a second cathode, as in Reaction 8 above. The overall reaction in this cell is:

$$3C+2CH_3OH+O_2 \leftrightarrow 2CO_2+CH_3CH_2CH_3 \quad \text{(Reaction 16)}$$

Using this electrolytic production means, 1.63 pounds of carbon react to produce a pound of propane.

Add three Carbons to provide twelve hydrogen ions in reaction with $4+3CO_2$ and at the two zone cathode $2CO+CH_4+8H^++8e$ gives $C_3H_8+2H_2O$ and on the other part of the cathode $4H^++4e+O_2 \rightarrow 2H_2O$. The cell has 0.364 volts to overcome OV end reaction.

At the anode, 1.5C gives $6H^+$and $6e+1.5CO_2$. The two part cathode is $CH_4+CH_3OH+CO+4H^++4e \rightarrow C_3H_8+2H_2O$ (the first part of the cathode) and $2H_2O+\tfrac{1}{2}O2 \rightarrow H_2O$ (the second part of the cathode). The cell has 0.475 volts to overcome OV end reaction.

Production Cells

A "traditional" electrolysis cell concept useful for the production of hydrocarbons using the methods of the present invention consists of a two-sided electrode having, on one facing side, an anode, and on the opposite facing side, a cathode. At the cathode, hydrogen ions and electrons react with oxygen to produce water and volts, which drive the reaction at the anode, and which can be externally connected to a second cathode on the other side. This second cathode produces the hydrocarbon, and can enhance that production. Preferably, the hydrogen ions at the cathode pass through a proton-conducting membrane to react with the oxygen and electrons and voltage is required to overcome the resistance in the proton-conducting membrane electrolytes and the overvoltage of the various electrodes. If the voltage is higher than that, it can be used with the amps produced at the anode to provide an external electric load. It may, however, be advantageous to utilize excess voltage in added hydrocarbon production.

In another cell design, two facing electrodes, one an anode and the other a cathode, are divided into two or more segments by barriers extending to a proton-transferring membrane that isolates cathodic electrolytes and gas additions (for instance, carbon monoxide and oxygen or air). This allows the single electrical conducting cathode to have catalytic surfaces that change in each segment, to maximize the reaction desired on that segment. This eliminates the outside cathode connection and permits the other side of the anode to be a part of a second cell.

Cell Variations:

For each of the hydrocarbon products cited, alternate production means are contemplated. Alternative production means each have advantages and disadvantages. For example, CO is a useful building block. An alternate scheme to those already suggested is to produce carbon dioxide from carbon, and react it at a cathode to carbon monoxide and water. A separate cathode or segmented cathode can be used to produce water. With a water-adsorbing electrolyte, the reactions are driven to completion as water is sequestered by the electrolyte.

In a traditional electrolytic cell, three carbons produce twelve hydrogen ions and electrons. Six of these are used to produce water and six to produce methane and water from CO. In a segmented cell, the same anodic reaction can be used to produce 3 hydrogen ions for water and nine for one and one half moles of methane and water. Thus, a pound of methane only requires 2.245 pounds of carbon instead of three pounds of carbon. Instead of using the external CO, carbon dioxide from the anode can be used. This results in a still further decrease in the amount of carbon from external sources needed for the reaction, but the reactions are more complex.

Methanol can be produced directly from CO or $CO_2$ using added water. The use of CO is preferred.

Ethanol similarly can be made directly from a single CO, two CO or $CO_2$. The use of two CO molecules is preferred.

Propane can also be prepared directly from a single molecule of CO, two molecules of CO, methanol, methanol and CO, ethanol, and ethanol and CO.

Additional objects, advantages, and novel features of this invention will become apparent to those skilled in the art upon examination of the examples described on the following pages.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiment described hereinabove is further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method of producing a hydrocarbon selected from the group consisting of: methane, and methanol comprising:
- charging an electrolytic cell with a carbon source, oxygen and an aqueous electrolyte, said cell comprising:
  - an anode; and
  - a cathode divided into two or more segments separated by barriers that isolate cathodic electrolytes and at least one gas addition,
- wherein the carbon source is a carbon in fine, cross-linked chains having a particle size in the range of 2 microns to 20 microns in diameter; and
- producing said hydrocarbon through an electrochemical process within said cell.

2. The method of claim 1, wherein the hydrocarbon produced is methane, wherein the at least one gas addition is carbon monoxide, said method further comprising:
- charging said electrolytic cell with the carbon monoxide; and
- producing carbon dioxide and the methane through the electrochemical process within said cell.

3. The method of claim 2, wherein the carbon monoxide is thermally produced from carbon and oxygen.

4. The method of claim 2, wherein the carbon monoxide is electrochemically produced from carbon and water, and wherein the anode of said cell is a silver-plated anode.

5. The method of claim 1, wherein the hydrocarbon produced is methanol, and the cathode is a carbon cathode, said method further comprising:
- producing carbon dioxide and the methanol through the electrochemical process within said cell.

6. The method of claim 1, wherein the hydrocarbon produced is methanol, wherein the at least one gas addition is carbon monoxide, wherein said cathode is a copper plate cathode, said method further comprising:
- charging said electrolytic cell with the carbon monoxide; and
- producing carbon dioxide and the methanol through the electrochemical process within said cell.

7. The method of claim 1, wherein the cathode is a copper cathode.

8. The method of claim 1, wherein the aqueous electrolyte comprises cuprous chloride.

9. The method of claim 1, wherein the cathodic electrolytes comprises a catalyst selected from the group consisting of copper and cuprous chloride.

10. The method of claim 1, wherein the hydrocarbon produced is methane, said method further comprising:
- producing carbon dioxide and the methane through the electrochemical process within said cell.

11. A method of producing a hydrocarbon selected from the group consisting of:
- ethanol, and propane comprising:
  - charging an electrolytic cell with a carbon source, oxygen and an aqueous electrolyte, said cell comprising:
    - an anode; and
    - a cathode divided into two or more segments separated by barriers that isolate cathodic electrolytes,
  - wherein the carbon source is a carbon in fine, cross-linked chains having a particle size in the range of 2 microns to 20 microns in diameter; and
  - producing said hydrocarbon through an electrochemical process within said cell.

12. The method of claim 11, wherein the hydrocarbon produced is ethanol, said method further comprising:
- producing carbon dioxide and the ethanol through the electrochemical process within said cell.

13. The method of claim 11, wherein the hydrocarbon produced is propane, said method further comprising:

charging said electrolytic cell with methanol; and producing carbon dioxide and the propane through the electrochemical process within said cell.

14. The method of claim 11, wherein the cathode is a copper cathode.

15. The method of claim 11, wherein the aqueous electrolyte comprises cuprous chloride.

* * * * *